US011703020B2

(12) United States Patent
Fischer et al.

(10) Patent No.: US 11,703,020 B2
(45) Date of Patent: Jul. 18, 2023

(54) PRIMING PUMP

(71) Applicant: Caterpillar Inc., Peoria, IL (US)

(72) Inventors: Jeffery Fischer, Brimfield, IL (US); Neil Edward Johnston, East Peoria, IL (US); Brenton William Bush, Dunlap, IL (US); Ye Tian, Bloomington, IL (US); Quinton Burcar, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/650,039

(22) Filed: Feb. 4, 2022

(65) Prior Publication Data

US 2022/0243690 A1 Aug. 4, 2022

Related U.S. Application Data

(63) Continuation of application No. 17/248,667, filed on Feb. 2, 2021, now Pat. No. 11,274,641.

(51) Int. Cl.

| | |
|---|---|
| ***F02M 37/16*** | (2006.01) |
| ***F02M 37/00*** | (2006.01) |
| ***F02M 37/44*** | (2019.01) |
| ***F04B 9/14*** | (2006.01) |

(52) U.S. Cl.

CPC ..... *F02M 37/16* (2013.01); *F02M 37/0023* (2013.01); *F02M 37/44* (2019.01); *F04B 9/14* (2013.01)

(58) Field of Classification Search

CPC .... F02M 37/16; F02M 37/0023; F02M 37/44; F02M 59/12; F02M 59/42; F04B 9/14; F04B 49/035; F04B 49/24; F04C 2210/203; F04C 2/10; F04C 14/06; F04C 14/26

See application file for complete search history.

(56) References Cited

U.S. PATENT DOCUMENTS

| | | | |
|---|---|---|---|
| 3,500,759 | A | 3/1970 | Potter et al. |
| 3,664,318 | A | 5/1972 | Giuffra |
| 4,662,827 | A | 5/1987 | Wiernicki |
| 4,773,277 | A | 9/1988 | Cook et al. |
| 4,897,025 | A | 1/1990 | Negishi |
| 5,534,161 | A | 7/1996 | Tarr et al. |
| 6,672,853 | B2 | 1/2004 | Ewald |

(Continued)

OTHER PUBLICATIONS

Written Opinion and International Search Report for Int'l. Patent Appln. No. PCT/US2022/013095, dated Apr. 29, 2022 (11 pgs).

*Primary Examiner* — Jacob M Amick
*Assistant Examiner* — Charles J Brauch

(57) ABSTRACT

A priming pump may include a housing; an inlet passageway inside of the housing; an outlet passageway inside of the housing; a divider, inside of the housing, separating the inlet passageway and the outlet passageway; a connecting passageway through the divider in fluid communication with the inlet passageway and the outlet passageway; a valve, disposed in the connecting passageway, configured for one-way fluid flow from the inlet passageway to the outlet passageway; a rotary pump, inside of the housing, having an inlet in fluid communication with the inlet passageway and an outlet in fluid communication with the outlet passageway; and a shaft connected to the rotary pump and extending through the housing, the shaft configured for rotation by an external driving mechanism.

20 Claims, 4 Drawing Sheets

(56) References Cited

U.S. PATENT DOCUMENTS

| | | | | |
|---|---|---|---|---|
| 6,688,498 | B1 | 2/2004 | McGuffey | |
| 7,188,601 | B1 | 3/2007 | Trease | |
| 9,638,328 | B2 | 5/2017 | Hisada et al. | |
| 10,619,634 | B1 | 4/2020 | Lundberg et al. | |
| 2005/0158180 | A1* | 7/2005 | Wagner | F02M 37/18<br>417/244 |
| 2007/0216151 | A1* | 9/2007 | Asamura | F02M 37/103<br>280/833 |
| 2020/0094176 | A1* | 3/2020 | Batchelor | B01D 35/30 |

* cited by examiner

PRIMING PUMP

CROSS-REFERENCE TO RELATED APPLICATION(S)

This patent application is a continuation of and claims the benefit of priority to U.S. Nonprovisional patent application Ser. No. 17/248,667, filed on Feb. 2, 2021, the entirety of which is incorporated herein by reference.

TECHNICAL FIELD

The present disclosure relates generally to fuel systems for internal combustion engines and, for example, to a priming pump.

BACKGROUND

A fuel system for use with an internal combustion engine may include a pump, a tank, a filter, a regulating valve, and fuel injectors, and a series of conduits that interconnect these components. The tank is located upstream from the pump, whereas the filter, the regulating valve, and injectors are located downstream from the pump. The pump has an inlet and an outlet and draws fuel from the tank into the inlet and discharges fuel from the outlet to the other components of the system.

Air or vapor can enter these fuel systems, causing the pump to dry out and lose pressure. This pressure loss may render the pump unable to overcome restriction created by the resistance of the filter, the regulating valve, and the injectors. Thus, the pump becomes unable to pump fuel to the injectors. This may cause the engine to stall, operate inefficiently, or fail to start. When this occurs, the fuel system must be primed. Priming purges/bleeds air from the system, thereby rewetting the pump so that the pump can pump fuel through the filter and to the injectors. For example, a priming pump may be connected to the filter and operated to move fuel through the filter.

In some cases, a hand priming pump may be used to push air out of the fuel system, thereby priming the fuel system. To operate the hand priming pump, an operator may pull and push a piston of the hand priming pump. However, an operator does not always have the time or the strength to pump the number of strokes necessary for properly priming of the fuel system. For example, proper priming may require dozens of strokes of the hand priming pump, which may be physically exhausting to the operator. Additionally, the hand priming pump may fail to consistently produce reliable priming due to different pumping forces and/or pumping speeds that may be used by different operators or that may be used for different priming procedures.

U.S. Pat. No. 7,188,601 (the '601 patent) discloses an oil pump having an oil pump body assembly with a pair of gerotors on each side. The '601 patent indicates that the oil pump is driven by a shaft connected to a cam shaft of an engine. In addition, the '601 patent indicates that the oil pump has a cam support plate attached to the engine block. The '601 patent also discloses that the cam support plate has a pressure relief valve.

However, the oil pump of the '601 patent is not suitable for use as a priming pump. The oil pump of the '601 patent is driven by a shaft connected to a cam shaft of an engine, and therefore, the oil pump operates only when the engine is running. Thus, the oil pump of the '601 patent cannot be driven by an external driving mechanism, such as a handheld drill, or driven manually. Moreover, the oil pump of the '601 patent connects to an engine block via a cam support plate, which is not suitable for connecting the pump to a fuel filter assembly to permit use of the pump for priming. Additionally, the pressure relief valve of the '601 patent's oil pump is not located in the oil pump body assembly, and therefore, fluid cannot bypass the pump via the pressure relief valve during operation of the engine when priming is not needed.

The priming pump of the present disclosure solves one or more of the problems set forth above and/or other problems in the art.

SUMMARY

A priming pump includes a housing; an inlet passageway inside of the housing; an outlet passageway inside of the housing; a divider, inside of the housing, separating the inlet passageway and the outlet passageway; a connecting passageway through the divider in fluid communication with the inlet passageway and the outlet passageway; a valve, disposed in the connecting passageway, configured for one-way fluid flow from the inlet passageway to the outlet passageway; a rotary pump, inside of the housing, having an inlet in fluid communication with the inlet passageway and an outlet in fluid communication with the outlet passageway; and a shaft connected to the rotary pump and extending through the housing, the shaft configured for rotation by an external driving mechanism.

A priming pump includes a housing including a mounting structure for mounting the housing to a fuel filter assembly; an inlet passageway inside of the housing; an outlet passageway inside of the housing; a divider, inside of the housing, separating the inlet passageway and the outlet passageway; a rotary pump, inside of the housing, having an inlet in fluid communication with the inlet passageway and an outlet in fluid communication with the outlet passageway; and a shaft connected to the rotary pump and extending through the housing.

A fuel system includes a fuel filter assembly; and a priming pump, comprising: a housing including at least one aperture configured for mounting the housing to the fuel filter assembly; an inlet passageway inside of the housing; an outlet passageway inside of the housing; a divider, inside of the housing, separating the inlet passageway and the outlet passageway; a rotary pump, inside of the housing, having an inlet in fluid communication with the inlet passageway and an outlet in fluid communication with the outlet passageway; and a shaft connected to the rotary pump and extending through the housing, the shaft configured for rotation by an external driving mechanism.

DETAILED DESCRIPTION

This disclosure relates to a priming pump, which is applicable to any machine that uses an internal combustion engine, such as a diesel engine. For example, the machine may be a vehicle, a compactor machine, a paving machine, a cold planer, a grading machine, a backhoe loader, a wheel loader, a harvester, an excavator, a motor grader, a skid steer loader, a tractor, a dozer, or the like.

Figure 1:
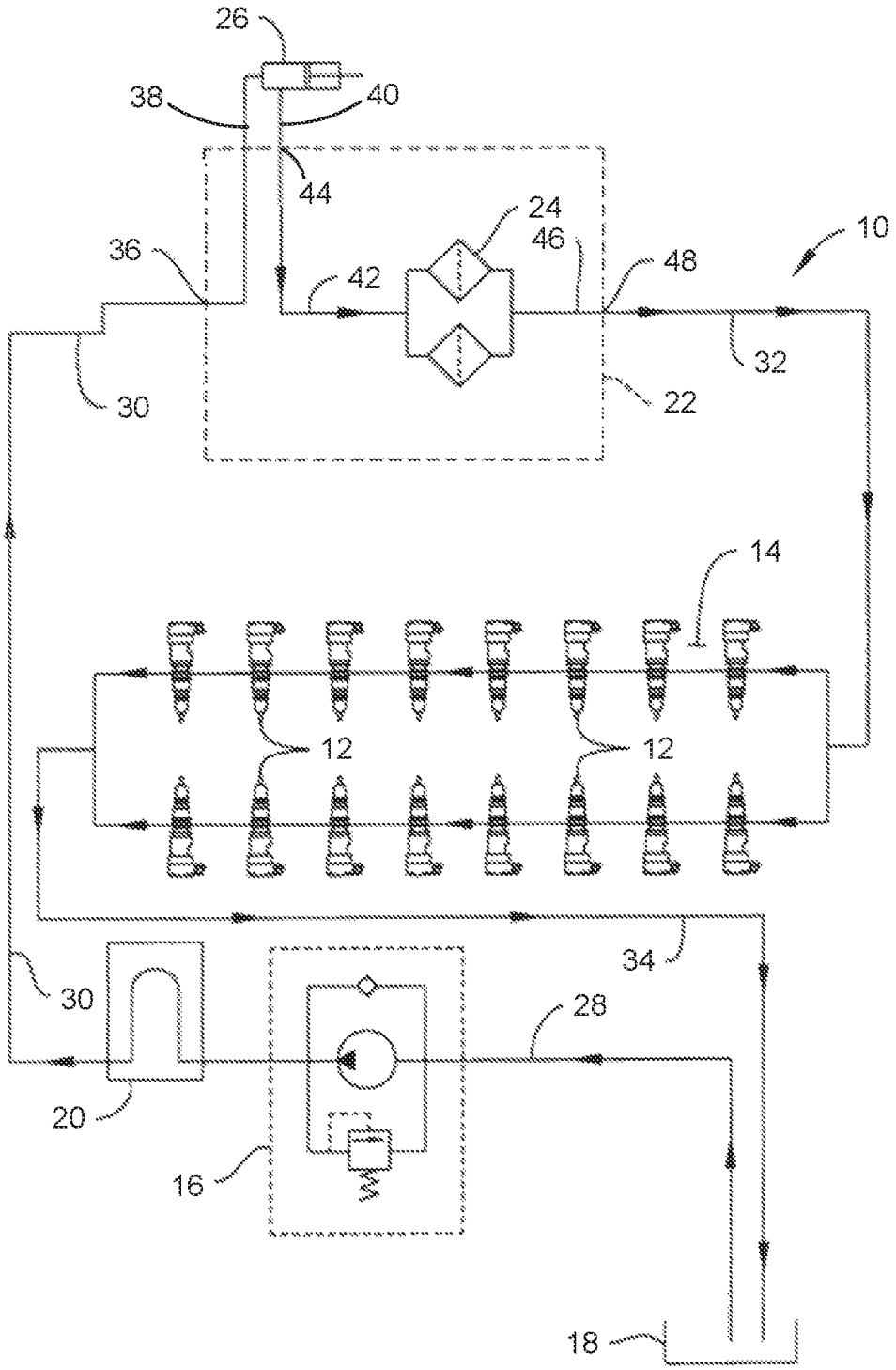
FIG. 1 is a diagram of an example fuel system described herein.

FIG. 1 is a diagram of an example fuel system 10 described herein. Fuel system 10 includes a supply pump 16 fluidly positioned between a fuel tank 18 and a plurality of fuel injectors 12. As shown in FIG. 1, fuel injectors 12 are mounted in a cylinder head 14 for direct injection into an engine cylinder for compression ignition. However, in some implementations, the fuel system 10 may be configured for another type of internal combustion engine.

Fuel system 10 includes a fuel filter assembly 22 that includes one or more filters 24. Fuel system 10 includes a priming pump 26 connected to the fuel filter assembly 22. Fuel system 10 includes a controller 20 (e.g., an electronic control module) that can control various aspects of fuel system 10, such as controlling fuel injection timing and quantity.

As shown in FIG. 1, fuel is drawn by supply pump 16 from fuel tank 18 via a pump supply passage 28. An outlet of supply pump 16 is connected to a pump outlet passage 30, where fuel passes through fuel filter assembly 22 into an injector supply passage 32. After flowing through injectors 12, residual fuel enters a drain passage 34 for eventual return to fuel tank 18. Priming pump 26 operates by drawing fluid in through priming inlet port 36 into priming inlet 38. Fluid leaving priming pump 26 passes through a priming outlet 40 into a filter supply passage 42, which is connected to filter inlet port 44. Fluid in filter supply passage 42 is filtered in filter(s) 24 and then passes into filter outlet passage 46 before leaving fuel filter assembly 22 via filter outlet port 48.

Fuel filter assembly 22 and priming pump 26 are shown in FIG. 1 as being located downstream of supply pump 16. However, in some examples, fuel filter assembly 22 and priming pump 26 may be located upstream of supply pump 16. Moreover, filter(s) 24 are shown in FIG. 1 as being located downstream of priming pump 26. Additionally, or alternatively, filter(s) 24 may be located upstream of priming pump 26. In some implementations, a separate priming supply passage is connected to fuel tank 18, fuel filter assembly 22, and injector supply passage 32. Thus, priming pump 26 may be included in a separate fluid circuit than supply pump 16.

As indicated above, FIG. 1 is provided as an example. Other examples may differ from what is described with regard to FIG. 1.

Figure 2:
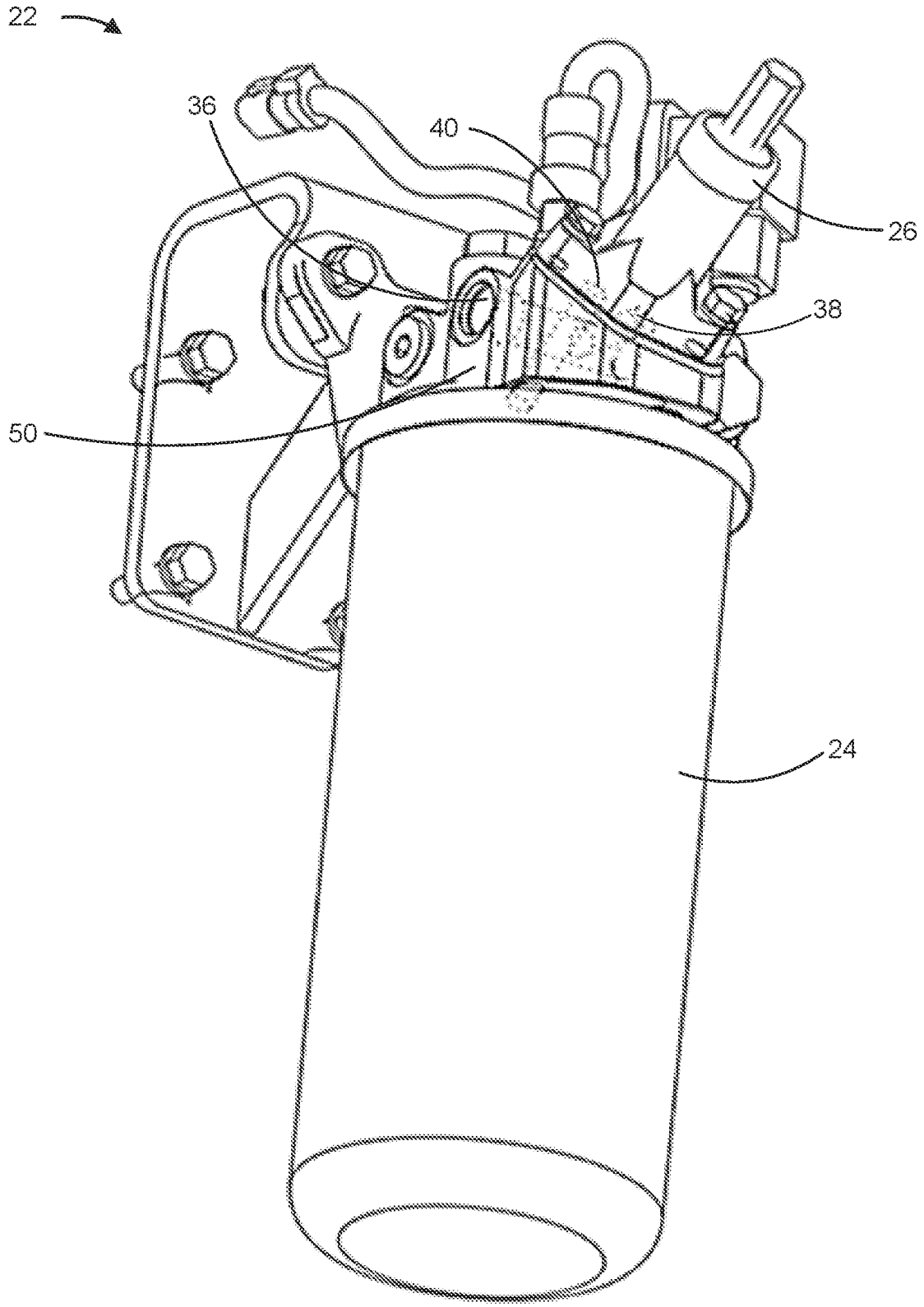
FIG. 2 is a diagram of an example fuel filter assembly and priming pump of the fuel system of FIG. 1.

FIG. 2 is a diagram of an example fuel filter assembly 22 and priming pump 26 of fuel system 10. Fuel filter assembly 22 includes a filter head assembly 50 attached to at least one filter 24. Filter head assembly 50 provides a common housing for various components and passageways. Priming pump 26 may be connected to filter head assembly 50 to provide fluid communication between priming pump 26 and filter(s) 24, as described above. Priming pump 26 and fuel filter assembly 22 are shown in FIG. 2 as being directly connected. However, in some examples, priming pump 26 and fuel filter assembly 22 may be connected by one or more passages. Moreover, there may be one or more components of fuel system 10 between priming pump 26 and fuel filter assembly 22. For example, supply pump 16 may be located between priming pump 26 and fuel filter assembly 22.

As indicated above, FIG. 2 is provided as an example. Other examples may differ from what is described with regard to FIG. 2.

Figure 3:
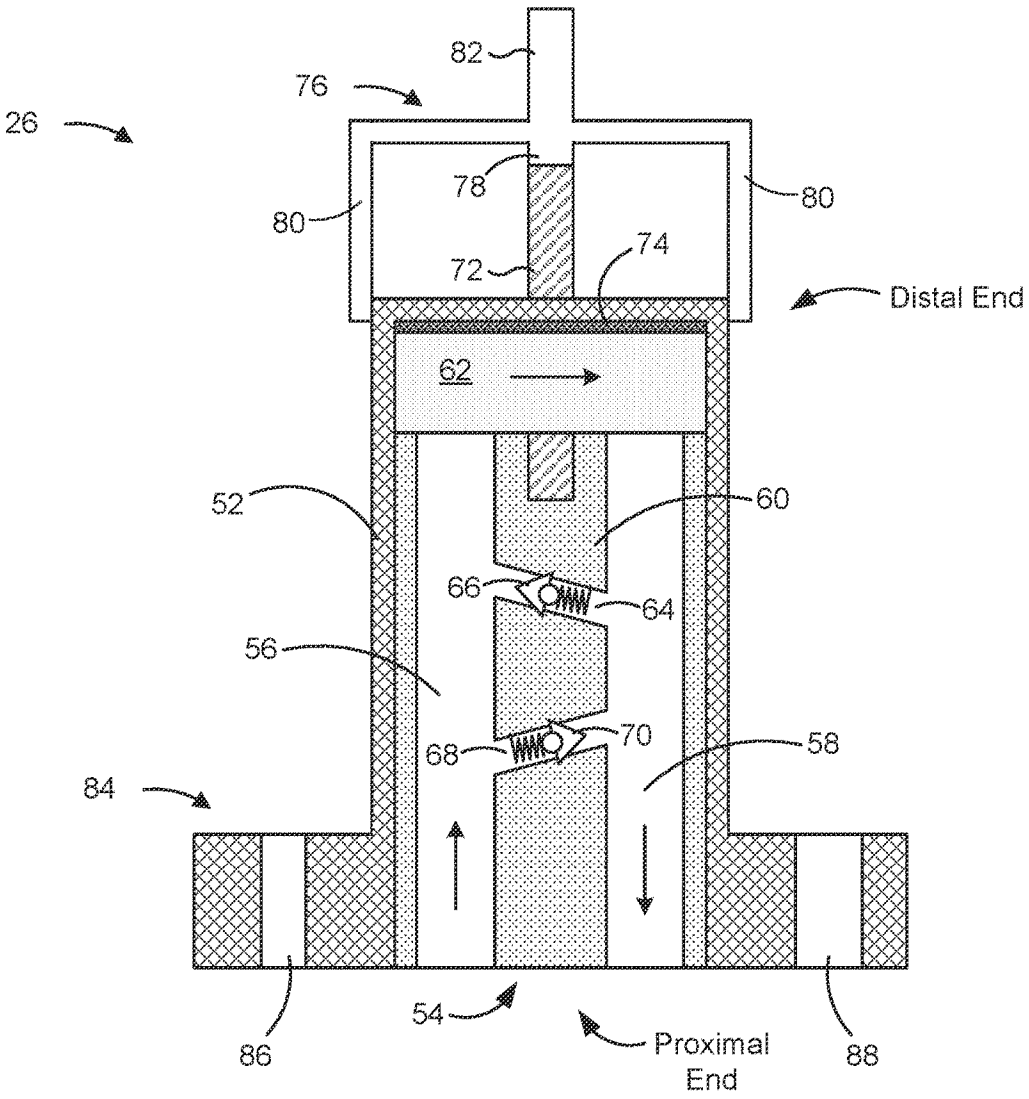
FIG. 3 is a diagram of a cross-section of the priming pump of the fuel system of FIG. 1.

FIG. 3 is a diagram of a cross-section of priming pump 26 of fuel system 10. Priming pump 26 includes a housing 52. The housing 52 may include a generally cylindrical central body having a proximal end, configured to interface with fuel filter assembly 22, and a distal end opposite the proximal end. Housing 52 includes a pumping chamber 54 defined inside of the central body of housing 52.

Pumping chamber 54 includes an inlet passageway 56 and an outlet passageway 58 separated by a divider 60. Inlet passageway 56 and outlet passageway 58 run along a length of the central body of housing 52. Inlet passageway 56, outlet passageway 58, and divider 60 may be formed in housing 52. For example, housing 52 may be molded or machined to define inlet passageway 56, outlet passageway 58, and divider 60. Alternatively, inlet passageway 56, outlet passageway 58, and divider 60 may be provided as one or more components in housing 52.

Pumping chamber 54 also includes a pump 62. Pump 62 may be a positive displacement pump, or any other hydraulic pump or similar component capable of supplying a flow of fluid. For example, pump 62 may be a rotary pump that moves fluid using a rotating mechanism. As an example, pump 62 may be a vane pump or a gear pump. The gear pump may be an external gear pump or an internal gear pump, such as a gerotor pump. The gerotor pump may employ an inner rotor having n teeth, and an outer rotor having n+1 teeth (where n is an integer greater than one). Pump 62 may be configured to rotate in a direction transverse to the inlet passageway 56 and the outlet passageway 58. In other words, pump 62 may be configured to rotate about an axis that is parallel to the inlet passageway 56 and the outlet passageway 58.

Pump 62 may be located at the distal end of the central body of housing 52 (e.g., at a location where inlet passageway 56 ends and outlet passageway 58 begins). Pump 62 includes an inlet in fluid communication with inlet passageway 56 and an outlet in fluid communication with outlet passageway 58. Operation of pump 62 draws fluid (e.g., from fuel tank 18), such as fuel, into the proximal end of priming pump 26 via inlet passageway 56. From inlet passageway 56, the fluid enters pump 62, where pump 62 may increase a pressure of the fluid. The fluid (e.g., pressurized fluid) exits pump 62 to outlet passageway 58. From outlet passageway 58 the fluid exits the proximal end of priming pump 26 (e.g., to fuel filter assembly 22). Thus, pump 62 drives fluid through priming pump 26 by rotational motion (e.g., transverse to the flow directions of fluid in inlet passageway 56 and outlet passageway 58) rather than by linear motion (e.g., parallel to the flow directions of fluid in inlet passageway 56 and outlet passageway 58).

Pumping chamber 54 may also include one or more connecting passageways and/or valves for controlling fluid flow. For example, a connecting passageway 64 may pass through divider 60. As an example, divider 60 may be molded or machined to include connecting passageway 64, and/or connecting passageway 64 may be a fluid-carrying component that passes through divider 60. Thus, connecting passageway 64 is in fluid communication with inlet passageway 56 and outlet passageway 58. Connecting passageway 64 is located in divider 60 such that fluid in inlet passageway 56 can enter connecting passageway 64 before reaching pump 62.

A valve 66 may be disposed in connecting passageway 64. Valve 66 may be a one-way valve configured for one-way fluid flow from inlet passageway 56 to outlet passageway 58. For example, valve 66 may be a check valve, such as a ball check valve. Valve 66 may be configured to open, and permit fluid to flow from inlet passageway 56 to outlet passageway 58 (e.g., bypassing pump 62), when a pressure in inlet passageway 56 satisfies a threshold pressure. For example, the pressure may satisfy the threshold pressure if pump 62 is rotated in reverse and fluid is directed from outlet passageway 58 to inlet passageway 56. As another example, the pressure may satisfy the threshold pressure if fluid is moving through fuel system 10 and pump 62 is idle. In particular, during operation of a machine that includes fuel system 10 (e.g., during normal operation of the machine and not during a priming procedure), supply pump 16 moves fluid through fuel system 10, as described above, and pump 62 is idle. Here, valve 66 may open to permit fluid to flow through connecting passageway 64 from inlet passageway 56 to outlet passageway 58. Thus, the fluid bypasses pump 62 during operation of the machine when pump 62 is idle.

An additional connecting passageway 68 may also pass through divider 60, in a similar manner as described above. Connecting passageway 68 is in fluid communication with inlet passageway 56 and outlet passageway 58. Connecting passageway 68 is located in divider 60 such that fluid in outlet passageway 58 can enter connecting passageway 68 before exiting priming pump 26. Connecting passageway 68 may be located between connecting passageway 64 and pump 62, or connecting passageway 64 may be located between connecting passageway 68 and pump 62.

An additional valve 70 may be disposed in connecting passageway 68. Valve 70 may be a one-way valve configured for one-way fluid flow from outlet passageway 58 to inlet passageway 56, in a similar manner as described above. Valve 70 may be configured to open, and permit fluid to flow from outlet passageway 58 to inlet passageway 56, when a pressure in outlet passageway 58 satisfies a threshold pressure. For example, the pressure may satisfy the threshold pressure if pump 62 is directing fluid to outlet passageway 58 at a rate that exceeds a rate at which the fluid exits outlet passageway 58 (e.g., due to resistance of the filter 24).

Priming pump 26 includes a shaft 72 (e.g., a drive shaft). Shaft 72 is connected to pump 62. For example, shaft 72 may connect to a rotor or a gear of pump 62 so that rotation of shaft 72 operates pump 62. Shaft 72 is an elongate rod having a first end and a second end. The first end of shaft 72 may be seated (e.g., in a bearing) in divider 60. Shaft 72 may extend through the distal end of housing 52 (e.g., through an orifice in the distal end of housing 52) such that a portion of shaft 72, at the second end of shaft 72, is located outside of housing 52. Shaft 72 may pass through a bearing disposed in the orifice. Priming pump 26 may include a gasket 74 (e.g., a ring gasket) that surrounds shaft 72. Gasket 74 may be located between pump 62 and an interior surface of the distal end of housing 52. Thus, gasket 74 seals pumping chamber 54 about shaft 72 to prevent fluid from escaping through the orifice in housing 52.

Shaft 72 is configured for rotation by an external driving mechanism. For example, shaft 72 may have a hexagonal cross section or another non-circular cross section. In this way, the external driving mechanism may couple with shaft 72 (e.g., the portion of shaft 72 extending through housing 52) to provide rotation to shaft 72, and thereby operate pump 62. The external driving mechanism may include a device that is not integrally connected to priming pump 26 and/or fuel system 10. Moreover, the external driving mechanism may include a device that is configured to produce rotational motion. For example, the external driving mechanism may be a handheld power drill or a manual crank. As an example, shaft 72 may couple with a hexagonal (hex) driver (e.g., a socket and/or a chuck) of a handheld power drill, such that operation of the drill provides rotation to shaft 72. In some implementations, a method may include adjoining an external driving mechanism (e.g., a handheld power drill) and shaft 72, and operating the external driving mechanism to provide rotation of shaft 72, thereby operating pump 62 and causing fluid (e.g., fuel) to flow through priming pump 26.

Priming pump 26 may include a shroud 76. Shroud 76 includes a coupling member 78 that couples with shaft 72 (e.g., the portion of shaft 72 extending through housing 52). For example, the coupling member 78 may include a socket that couples with shaft 72. As an example, the socket may include a hexagonal socket or a threaded socket that couples with a hexagonal rod or a threaded rod, respectively, of shaft 72. Shroud 76 also includes a canopy 80. Canopy 80, shown as an upside-down U-shaped component, may surround shaft 72 and the distal end of housing 52 to prevent debris from entering housing 52 via the orifice for shaft 72. Shroud 76 also includes a shaft 82 configured for rotation by an external driving mechanism in a similar manner as described above. Thus, shaft 82 of shroud 76 may be rotated by the external driving mechanism, thereby rotating shaft 72 via the coupling member 78. In other words, the external driving mechanism may indirectly rotate shaft 72 by rotating shaft 82 of shroud 76 when shroud 76 is employed.

Shroud 76 may be removably connected to shaft 72. For example, shroud 76 may be threaded onto shaft 72, as described above, and removed and replaced when shroud 76 is spent. In some implementations, priming pump 26 may include a pin hole and/or a locking pin to facilitate removal and/or connection of shroud 76. The pin hole may be configured to receive the locking pin such that the locking pin engages with shaft 72 and/or pump 62 (e.g., engages with one or more gears or rotors of pump 62). The locking pin prevents rotation of shaft 72 and/or pump 62 to facilitate removal and/or connection of shroud 76.

Figure 4:
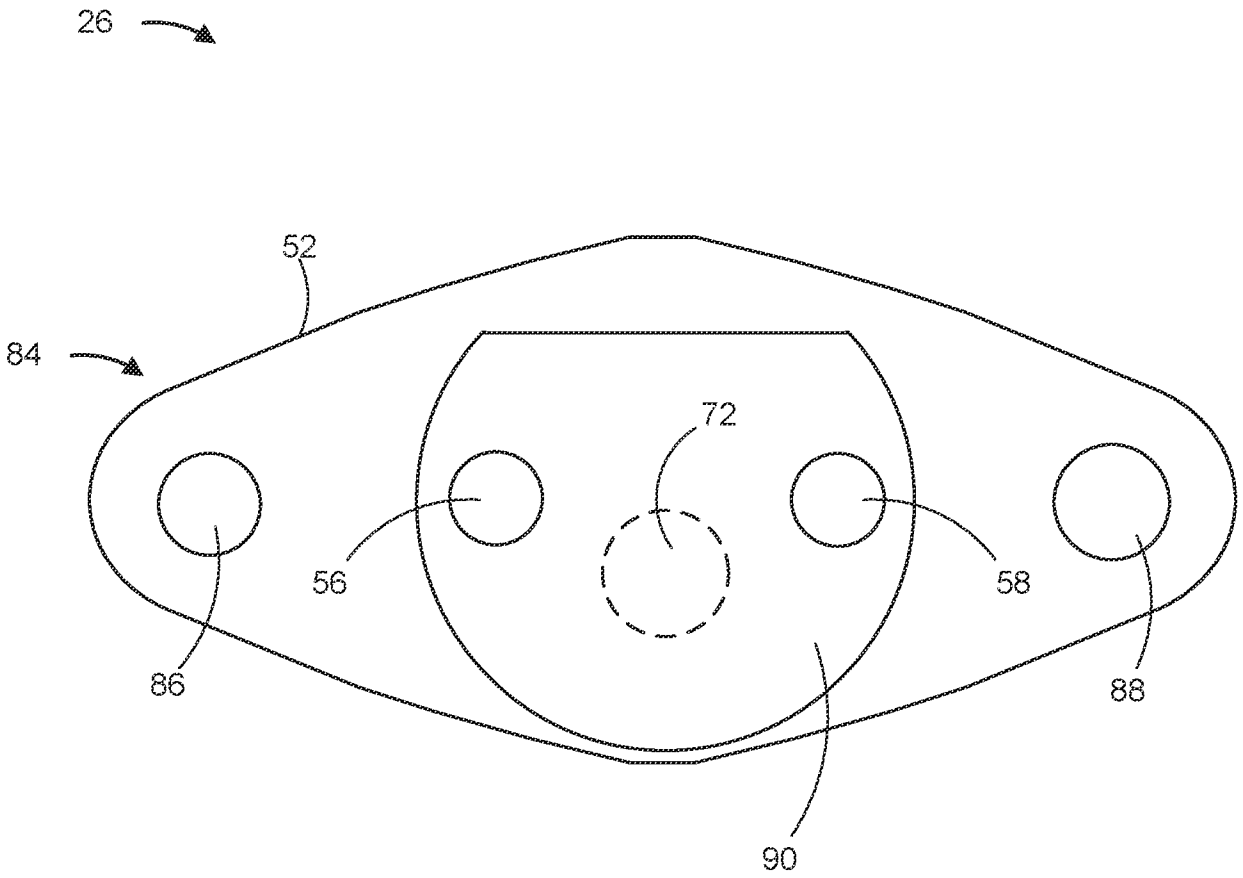
FIG. 4 is a diagram of a bottom view of the priming pump of the fuel system of FIG. 1.

Housing 52 also includes a mounting structure 84 for mounting of housing 52 to fuel filter assembly 22. The proximal end of housing 52 may interface with fuel filter assembly 22 (e.g., to supply fluid to fuel filter assembly 22) when housing 52 is mounted to fuel filter assembly 22. Mounting structure 84 may include a flange that projects about the proximal end of housing 52. The flange may be generally diamond-shaped in cross section (as shown in FIG. 4). Mounting structure 84 may include at least one aperture (e.g., in the flange) for receiving a fastener (e.g., a bolt). Thus, housing 52 may be mounted to the fuel filter assembly 22 by a fastener received in the at least one aperture. In some examples, mounting structure 84 may include a first aperture 86 (e.g., at an apex of the diamond-shaped flange) and a second aperture 88 (e.g., at an opposite apex of the diamond-shaped flange). First aperture 86 and second aperture 88 may have different diameters (e.g., for receiving differently sized bolts). This prevents housing 52 from being mounted backwards to fuel filter assembly 22 (e.g., where inlet passageway 56 and outlet passageway 58 are reversed relative to a fluid flow direction of fuel system 10).

As indicated above, FIG. 3 is provided as an example. Other examples may differ from what is described with regard to FIG. 3.

FIG. 4 is a diagram of a bottom view of priming pump 26 of fuel system 10. As shown in FIG. 4, priming pump 26 may include an alignment member 90 located at the proximal end of housing 52. For example, housing 52 may be molded or machined to include alignment member 90. Alignment member 90 may be a projection from housing 52 or a recess in housing 52. Alignment member 90 has a cross section that is non-symmetrical about at least one central line (e.g., the cross section may have at most one line of symmetry). For example, the cross section may be a circle segment. Alignment member 90 may couple with a corresponding member of fuel filter assembly 22. For example, if alignment member 90 is a recess in housing 52, alignment member 90 may couple with a similarly-shaped projection of fuel filter assembly 22. The non-symmetrical cross section of alignment member 90 may allow housing 52 to couple with fuel filter assembly 22 in only a single orientation, thereby preventing housing 52 from being mounted backwards to fuel filter assembly 22.

As also shown in FIG. 4, shaft 72 may be off-centered relative to a center of the central body of housing 52. For example, the central body may have a circular cross-section, and shaft 72 may be off-centered relative to a center of the circular cross-section. Stated differently, shaft 72 may be off-centered relative to a line that passes through inlet passageway 56 and outlet passageway 58. For example, the line does not intersect with shaft 72. This configuration may be used when pump 62 is a gerotor, which may employ an inner rotor and an outer rotor that rotate about different axes. For example, the outer rotor may rotate about an axis at the center of the central body of housing 52, and the inner rotor may rotate about shaft 72.

As indicated above, FIG. 4 is provided as an example. Other examples may differ from what is described with regard to FIG. 4.

INDUSTRIAL APPLICABILITY

The disclosed fuel system 10 and/or priming pump 26 may be used with any machine that uses an internal combustion engine. For example, the disclosed fuel system 10 and/or priming pump 26 may be used with any machine that uses a diesel engine. The disclosed priming pump 26 is used to perform priming by purging air from the fuel system 10 to enable operation of the engine.

Typically, priming may be performed using a hand priming pump. To operate the hand priming pump, an operator may pull and push a piston of the hand priming pump. However, proper priming may require dozens of strokes of the hand priming pump, which may be physically exhausting to the operator. Moreover, the operator may not have the time or strength needed to pump the number of strokes necessary for properly priming of the engine.

The disclosed priming pump 26 facilitates improved priming that consumes minimal time and requires minimal effort of an operator. Rather than using a linear motion (e.g., pumping a piston) to drive fluid, priming pump 26 uses a rotational motion to drive fluid. For example, priming pump 26 includes pump 62, which may include a rotary pump, that draws fuel from fuel tank and expels the fuel to a remaining portion of fuel system 10. The rotary pump may be driven by rotating shaft 72 that is accessible to the operator. Thus, the operator may operate priming pump 26 using an external driving mechanism that produces rotational motion. For example, the external driving mechanism may be a handheld power drill.

The handheld power drill may be capable of rotational speeds that can cause the priming pump 26 to supply the necessary quantity of fuel for proper priming in a fraction of the amount of time that would otherwise be needed using a hand priming pump. Moreover, this may be done without significant manual effort by the operator. Furthermore, the handheld power drill can provide consistently reliable priming. Thus, priming can be performed faster, more consistently, and with less effort, relative to manual hand priming, using the disclosed priming pump 26.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A priming pump, comprising:

a housing;

an inlet passage;

an outlet passage;

a rotary pump inside the housing, the rotary pump having a proximal end facing the inlet passage, a distal end opposite the proximal end, an inlet in fluid communication with the inlet passage, and an outlet in fluid communication with the outlet passage, the inlet and the outlet being formed in the proximal end of the rotary pump; and a rotatable shaft connected to the rotary pump, the rotatable shaft extending outside of the housing to an exterior of the priming pump and through the distal end of the rotary pump.

2. The priming pump of claim 1, further comprising an inlet opening at a proximal end of the housing.

3. The priming pump of claim 2, further comprising an outlet opening at the proximal end of the housing.

4. The priming pump of claim 3, further comprising a first fastener opening overlapping the inlet opening and the outlet opening in a direction orthogonal to a proximal-distal direction.

5. The priming pump of claim 4, further comprising a second fastener opening overlapping the inlet opening and the outlet opening in the direction orthogonal to the proximal-distal direction.

6. The priming pump of claim 1, wherein the rotary pump is a vane pump.

7. The priming pump of claim 1, wherein the rotary pump is a gear pump.

8. The priming pump of claim 1, further comprising a connecting passage that fluidly connects the inlet passage and the outlet passage.

9. A priming pump, comprising:

a housing including a mounting structure for mounting the housing to a filter assembly;

an inlet passage;

an inlet opening at a proximal end of the housing;

an outlet passage;

an outlet opening at the proximal end of the housing;

a first fastener opening overlapping the inlet opening and the outlet opening in a direction orthogonal to a proximal-distal direction;

a divider inside the housing and separating the inlet passage and the outlet passage;

a rotary pump inside the housing and fluidly connected between the inlet passage and the outlet passage; and a shaft connected to the rotary pump and extending through the housing, a center axis of the shaft being offset from a center of the housing.

10. The priming pump of claim 9, wherein the center of the housing is formed at a center of the mounting structure.

11. The priming pump of claim 10, wherein the center of the mounting structure is defined by a line that extends through a radial center of the inlet opening and a radial center of the outlet opening.

12. The priming pump of claim 9, wherein the center of the housing is formed by an axis of rotation of the rotary pump.

13. The priming pump of claim 9, wherein the rotary pump includes a first axis of rotation defined by a first component and a second axis of rotation defined by a second component, wherein first axis extends through the center of the housing and the second axis is aligned with the shaft.

14. The priming pump of claim 9, wherein the shaft is sized to be received and rotated by an external driving mechanism.

15. A fuel system, comprising:

a fuel filter having a closed proximal end and an open distal end; and a priming pump, comprising:

a housing including at least one aperture configured for mounting the priming pump closer to the distal end of the fuel filter as compared to the proximal end of the fuel filter;

an inlet passage;

an outlet passage, the inlet passage and the outlet passage extending obliquely away from the open distal end of the fuel filter;

a rotary pump, inside the housing, having an inlet in fluid communication with the inlet passage and an outlet in fluid communication with the outlet passage; and a shaft connected to the rotary pump and extending through the housing, the shaft extending obliquely relative to the open distal end of the fuel filter.

16. The fuel system of claim 15, further comprising a filter assembly structure, the priming pump connected to the filter assembly structure so as to enable fluid communication between the priming pump and the fuel filter via the filter assembly structure.

17. The fuel system of claim 16, wherein the filter assembly structure is secured to the open distal end of the fuel filter.

18. The fuel system of claim 17, wherein the priming pump includes a mounting aperture for securing the priming pump to the filter assembly structure.

19. The priming pump of claim 1, further including a coupling member covering the rotatable shaft.

20. The priming pump of claim 19, wherein the coupling member includes an additional shaft sized to be received and rotated by an external driving mechanism.

* * * * *